US006358363B1

(12) United States Patent
Henricson

(10) Patent No.: US 6,358,363 B1
(45) Date of Patent: Mar. 19, 2002

(54) METHOD AND APPARATUS FOR BLEACHING PULP USING TWO FLUIDIZING MIXERS

(75) Inventor: Kaj Henricson, Helsinki (FI)

(73) Assignee: Andritz-Ahlstrom Oy, Espoo (FI)

( * ) Notice: Subject to any disclaimer, the term of this patent is extended or adjusted under 35 U.S.C. 154(b) by 713 days.

(21) Appl. No.: 08/448,585

(22) PCT Filed: Oct. 22, 1993

(86) PCT No.: PCT/FI93/00434

§ 371 Date: Apr. 18, 1996

§ 102(e) Date: Apr. 18, 1996

(87) PCT Pub. No.: WO94/13879

PCT Pub. Date: Jun. 23, 1994

(30) Foreign Application Priority Data

Dec. 7, 1992 (FI) ..... 925558

(51) Int. Cl.[7] ..... D21C 9/153

(52) U.S. Cl. ..... 162/57; 162/65; 162/243

(58) Field of Search ..... 162/57, 65, 243, 162/237, 242, 241

(56) References Cited

U.S. PATENT DOCUMENTS

| | | | | | |
|---|---|---|---|---|---|
| 3,966,542 A | * | 6/1976 | Oldshue | ..... | 162/57 |
| 4,093,506 A | * | 6/1978 | Richter | ..... | 162/57 |
| 4,372,812 A | | 2/1983 | Phillips et al. | ..... | 162/78 |
| 5,411,633 A | * | 5/1995 | Phillips et al. | ..... | 162/57 |
| 5,411,634 A | * | 5/1995 | Henricson et al. | ..... | 162/65 |

FOREIGN PATENT DOCUMENTS

| | | | | | |
|---|---|---|---|---|---|
| CA | 2012771 | | 3/1996 | | |
| CA | 2069436 | | 8/1996 | | |
| DE | 4039099 | | 7/1991 | | |
| EP | 397308 | | 11/1990 | | |
| EP | 492 040 | * | 1/1992 | ..... | 162/65 |
| FR | 2 620 744 | * | 3/1989 | ..... | 162/65 |
| WO | WO 92/07999 | | 5/1992 | | |

* cited by examiner

*Primary Examiner*—Steve Alvo
(74) *Attorney, Agent, or Firm*—Nixon & Vanderhye P.C.

(57) ABSTRACT

A method and apparatus for bleaching medium consistency pulp with ozone using at least 2 fluidizing mixers to mix ozone and carrier gas into the pulp. The method is particularly applicable when the volume of the bleaching gas is larger than the volume used in conventional ozone bleaching, e.g. 2 $m^3$/adt.

20 Claims, 5 Drawing Sheets

METHOD AND APPARATUS FOR BLEACHING PULP USING TWO FLUIDIZING MIXERS

FIELD OF INVENTION

The present invention relates to a method of and an apparatus for bleaching medium consistency, the consistency being from 5 to 25%, preferably from 10 to 15%, pulp. The method of the invention is particularly well applicable in applications where the volume of the gas used for the bleaching is larger then in the conventional ozone bleaching e.g. exceeding 2 $m^3$/adt.

BACKGROUND ART

Many prior art publications on bleaching of medium consistency pulp are already known, the first of which is European patent application no. 397308 of A. Ahlstrom Corporation. The invention has resulted in several mill-scale applications, already. Said EP application describes for the first time in detail how ozone bleaching can be effected at the medium consistency range in a way acceptable in industrial mill-scale operation. According to the publication, pressurized gas consisting mainly of carrier gas and ozone is mixed in a fluidixing mixer into pulp so as to produce a foamy suspension of liquid, gas and fibers, the suspension being transported from the mixer to a reaction vessel which may be a larger vessel or, for example, a portion of the flow channel subsequent to the mixer. After the ozone reaction, residual gas is separated from the suspension, said gas consisting mainly, as is known, of the carrier gas mixed with the ozone into the pulp. If it is desirable to introduce a larger amount of ozone into the pulp, it is possible according to the publication to employ two or more fluidizing ozone mixers for example by introducing the pulp subsequent to the first ozone reactor and the gas separation to a second fluidizing mixer in which another dose of pressurized mixture or ozone and carrier gas is mixed into the pulp and from which the pulp is directed further to a second reactor, etc.

A German patent application DE-A-40 39 099 discloses medium consistency ozone bleaching in combination with chlorine dioxide. The main goal of the method is to effect both the ozone and chlorine dioxide bleaching simultaneously without intermediate washing. The publication discusses also an optional method of mixing ozone with pulp by means of several mixers connected in series. Said method is similar to the one described in the above mentioned EP patent application i.e. fresh ozone is introduced into each mixer and mixed thereby with pulp.

Also WO publication no. 93/00470 is known which discloses a bleaching method different from the method described above. Also according to this publication the mixture of ozone and carrier gas is mixed into the pulp by a fluidizing mixer and the mixture of gas and pulp is introduced under pressure to a reaction vessel. In the upper section of the reaction vessel, gas is separated from the pulp and additional chemicals, such as sodium hydroxide, hydrogen peroxide or chlorine dioxide, are added to the pulp. After this the pulp flow is introduced to a second reaction vessel in which the pressure is maintained at a clearly lower level than in the first vessel. Gas is separated from the pulp also in the upper section of the second vessel from which it is transported to a separate further treatment or for other use.

Even though the apparatus described above already function in mill scale use they still have a few drawbacks, for example if it is desirable to improve the bleaching efficiency without increasing the size of the reaction vessel. For example, the method of the EP publication mentioned above requires, a separate reaction vessel and a separate gas separation apparatus for each ozone mixing stage, etc.

Also, it has been found out that in mill-scale experiments the amount of residual ozone in gas separation exceeds acceptable limits being in some applications more than 50 percents. Naturally, the higher is the amount of residual ozone the less is the brightness of the pulp improved in the ozone bleaching stage. One of the reasons for this high waste of ozone is the fact that the residence time of pulp in a mixer is not sufficient for ozone bleaching, especially, if the amount of ozone is high whereby ozone is, after the first fluidization stage, in the form of substantially large bubbles. One solution to the above addressed problem is discussed in the above mentioned EP patent application EP-A-0 397 308 i.e. dividing the ozone charge to several smaller ozone charges whereby the fluidizing mixer is able to mix the smaller amount of ozone more effectively and more evenly.

DISCLOSURE OF INVENTION

One of the objects of the present invention is to find another solution to the problem which reduces the equipment requirement and improves the bleaching efficiency of a pulp mill compared to conventional methods. The method of the invention allows the use of a larger gas dose, resulting either in the use of larger ozone volumes or in that use of weaker ozone mixtures in the bleaching. Compared with the solution of EP-A-0 397 308 only one ozone introduction pipe for the entire bleaching stage is needed resulting in reduced risk of ozone leaks in the mixers.

Another object of the invention is to find a solution to the problem relating to the excess waste of ozone. The method of the invention extends the efficient treatment time with ozone by means of arranging several fluidizing mixers in series to fluidize the pulp, ozone and carrier gas mixture the ozone and carrier gas being introduced into pulp in the first one/s of said fluidizing mixers. It is a characteristic feature of the invention that there is at least one fluidizing mixer in said series of mixers in which only unreacted ozone from a previous mixer is remixed with pulp.

BRIEF DESCRIPTION OF DRAWINGS

The method and the apparatus of the invention will be described by way of example more in detail with reference to the accompanying drawings of which

DETAILED DESCRIPTION OF PREFERRED EMBODIMENTS

Figure 1:
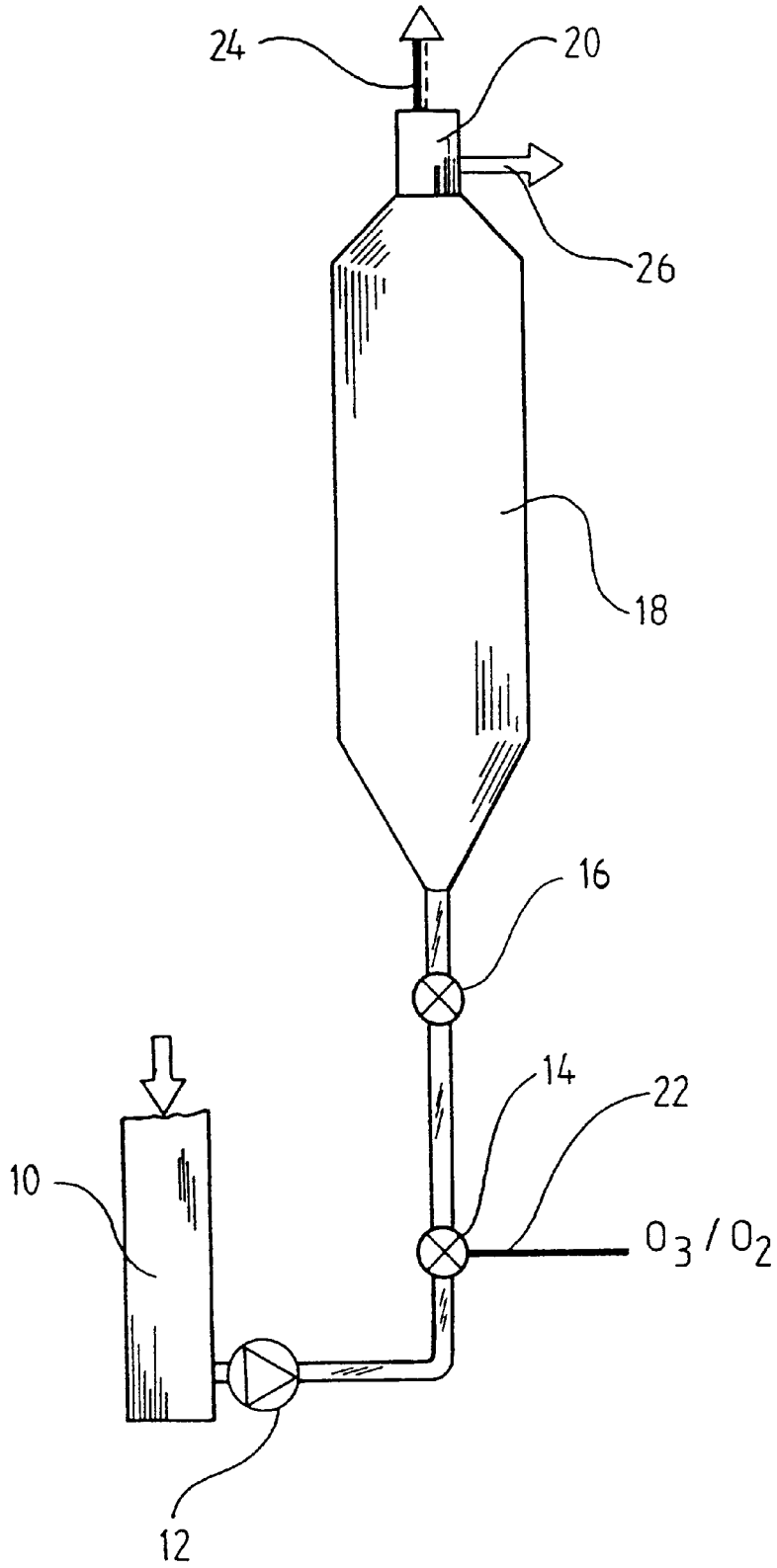
FIG. 1 illustrates a preferred embodiment of the apparatus according to the invention.

The apparatus according to FIG. 1 substantially comprises a drop leg or a corresponding means 10 supplying pulp at medium consistency from a preceding treatment stage; a pump 12, preferably a fluidizing centrifugal pump pumping the pulp; two fluidizing mixers 14 and 16; a reaction vessel 18; a gas separator 20; and a conduit for the mixture 22 of gas and carrier gas in the mixer 14, a conduit for the separated gas 24; and a conduit for the treated pulp 26 discharged from the apparatus. Further, the apparatus naturally comprises conduits for transport of pulp in the pump 12, in the mixers 14 and 16, in the reaction vessel 18 and in the gas separator 20. The separator 20 may be connected to the reaction vessel either directly in the discharge opening thereof or via a flow channel. The fluidizing mixers 14 and 16 are preferably of the type disclosed in CA patent no. 1,313,325 or WO publication no. 93/07961 by A. Ahlstrom Corporation, and the gas separators are preferably of the type disclosed in EP patent application no. 90302993.2 and WO publication no. 93/01875 by A. Ahlstrom Corporation, though also other types may be used.

The apparatus illustrated in the figure operates as follows: a mixture of ozone and carrier gas pressurized by means of the pump 12 (the carrier gas in the figure is oxygen but also other gases such as nitrogen or air can be used) is mixed into the pulp with a mixer 14 fluidizing the suspension of gas and pulp, the volume of the introduced gas mixture being clearly larger than in the method of the EP application mentioned above. Supplying a larger volume of ozone mixture into the pulp results in that the gas is no longer mixed properly with the pulp but large bubbles remain in the pulp. The second fluidizing mixer 16 is used to break up these gas bubbles and a foam of the type described in the above EP application is formed, in which form the mixture of gas and pulp is introduced into the reaction vessel. The operation of the second mixer 16 is facilitated by the fact that a remarkable portion of the ozone has already reacted with the fibers both in the mixer 14 and in the subsequent flow channel whereby the total gas volume in the suspension has reduced to some extent.

Tests have proved that this kind of a reactor application allows mixing efficiently 3–5 $m^3$/adt (air dry tons of pulp) of gas into the pulp. If larger volumes of gas are to be used the reaction vessel should be provided with a more slowly rotating mixer such as a paddle mixer in order to mix the created gas bubbles and the pulp. This kind of a mixer should preferably be used in the reaction vessel already with gas doses exceeding 2–3 $m^3$/adt. Reasons resulting in large total gas volumes are for example a high ozone dosage desired, possibly also a fairly low ozone content in the carrier gas.

Figure 2:
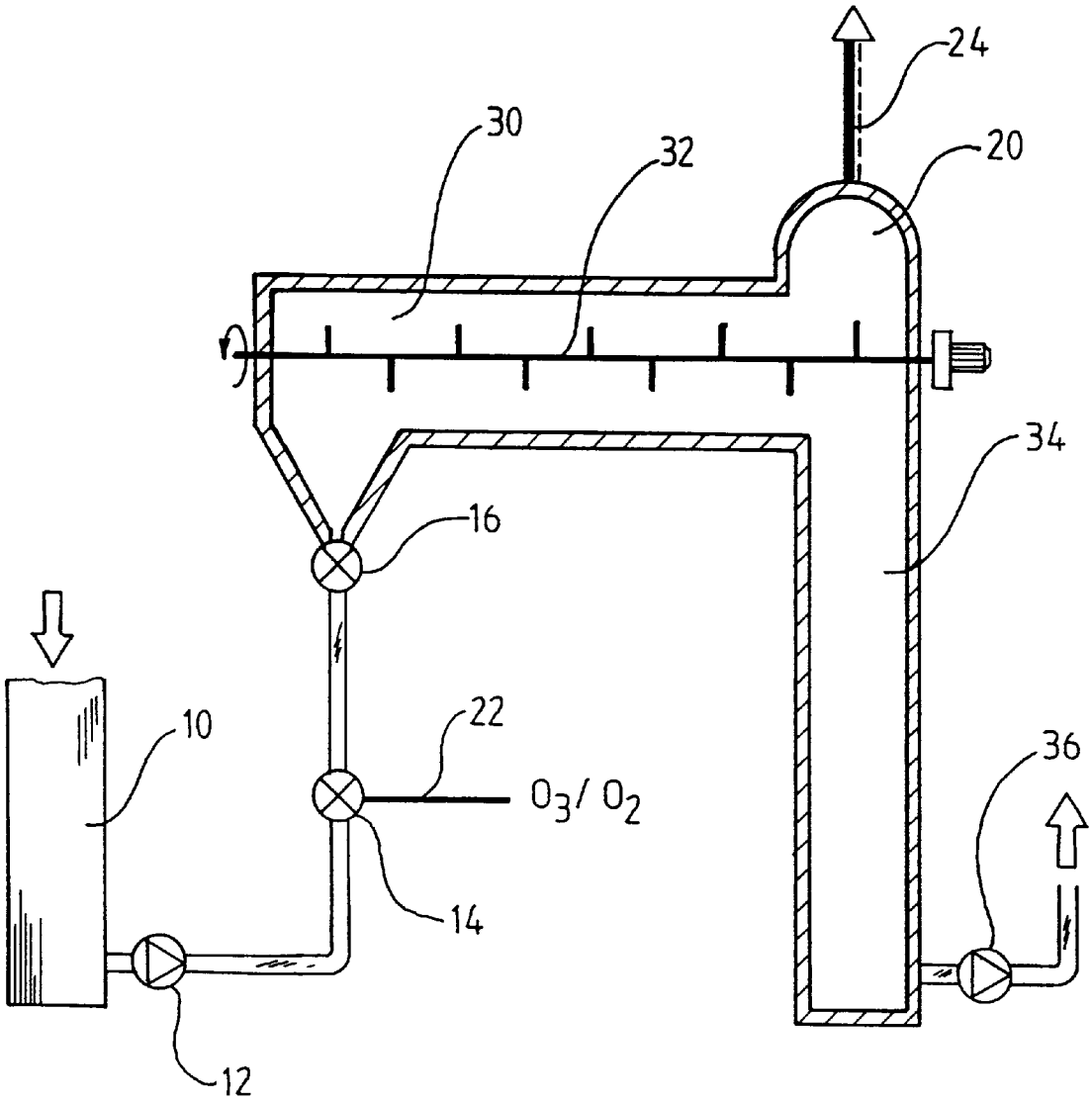
FIG. 2 illustrates a second preferred embodiment of the apparatus according to the invention.

FIG. 2 illustrates a second preferred embodiment of the invention in which the mixture of pulp and gas is discharged from has second mixer 16 to a reaction vessel 30 which in the figure has been illustrated as being horizontal but which may be also vertical or inclined. The reaction vessel 30 has been provided with a paddle mixer 32 which slowly mixes into the pulp gas bubbles which despite the foaming in mixers 14 and 16 remain in the pulp or have been separated in the pulp after said mixers. Subsequent to the paddle mixer 32, gas is separated from the pulp and the pulp is allowed to drop in a drop leg 34 to be pumped further by a pump 36. It is advisable also in this embodiment to use a combination of two fluidizing mixers and a tumbling mixer when the gas volume to be mixed exceeds 2–3 $m^3$/adt pulp.

EXAMPLE

Performed tests have proved that even slight mixing with a paddle mixer results in lower ozone contents in the separated residual gas and also in slightly more uniform bleaching result. Both of these observations confirm that tumbling of the pulp in the reactor intensifies ozone consumption. The most preferred retention time of the pulp in the reaction vessel has been found to be 30–150 seconds while the pressure is 6–15 bar in order to reduce the gas volume. Further, the temperature should be 50–90° C. and the pH between 3 and 5. The conditions in the bleaching reactor preferably are: the pressure 11 bar, the temperature 60° C., pH 3–5 and the retention time 120 seconds. Typically, the energy intensity of the mixer 32 rotating slowly in the vessel is only one tenth of the one of the fluidizing mixer and the energy consumption is approx. 0.05–0.25 kWh/1. At a production rate of 40 t/h, a motor or 50–200 kW is required to drive the mixer. Acquiring and using this kind of a motor and a mixer is very economical, compared to acquiring a second reaction vessel and the pipe lines and gas separators connected with it.

If the reactor vessel or reactor illustrated in FIG. 2 is in fact horizontal it is advantageous to provide it with partition walls so as to prevent the gas collected against the upper surface of the reactor from flowing directly to the gas discharge. For example, said partition wall may cover approx. the upper half of the cross sectional area of the reactor whereby the gas must, in order to proceed to the discharge, flow around the edge of the wall and is thus unavoidably mixed with the pulp.

Figure 3:
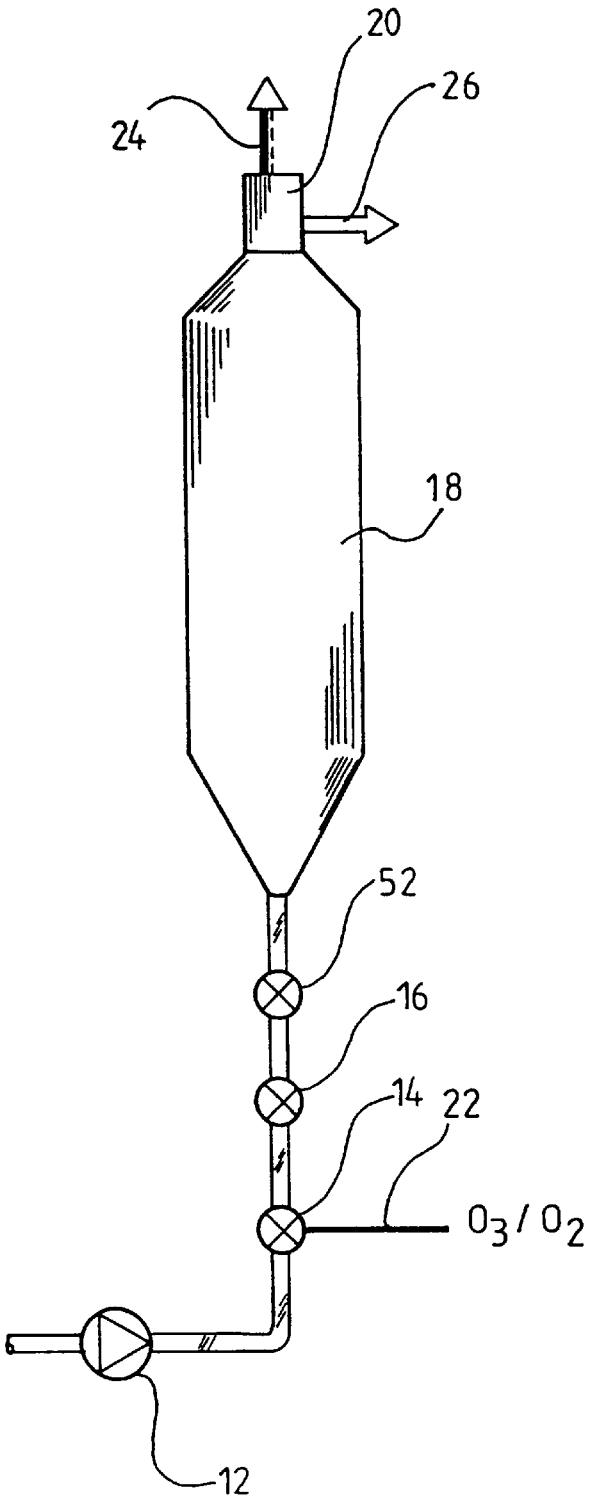
FIG. 3 illustrates a third preferred embodiment of the apparatus according to the invention.

In FIG. 3 there is illustrated yet another embodiment of the invention. Basically the arrangement is the same as in FIG. 1 the only exception being the third fluidizing mixer 52 in the pipeline leading front the pump 12 to the reaction vessel 18. By taking the third mixer 52 into use it is possible to introduce a larger amount of ozone and carrier gas mixture into the pulp in mixer 14 without a need to use a tumbling mixer in the reaction vessel 18. Also it is possible to add ozone in the second mixer 16 if such is found applicable. The ozone consumption between the mixers may, naturally, be ensured by enlarging the diameter of the flow channel between the mixers or by extending the flow paths to make sure that there is sufficient retention time for the ozone to react with the fiber material.

Figure 4:
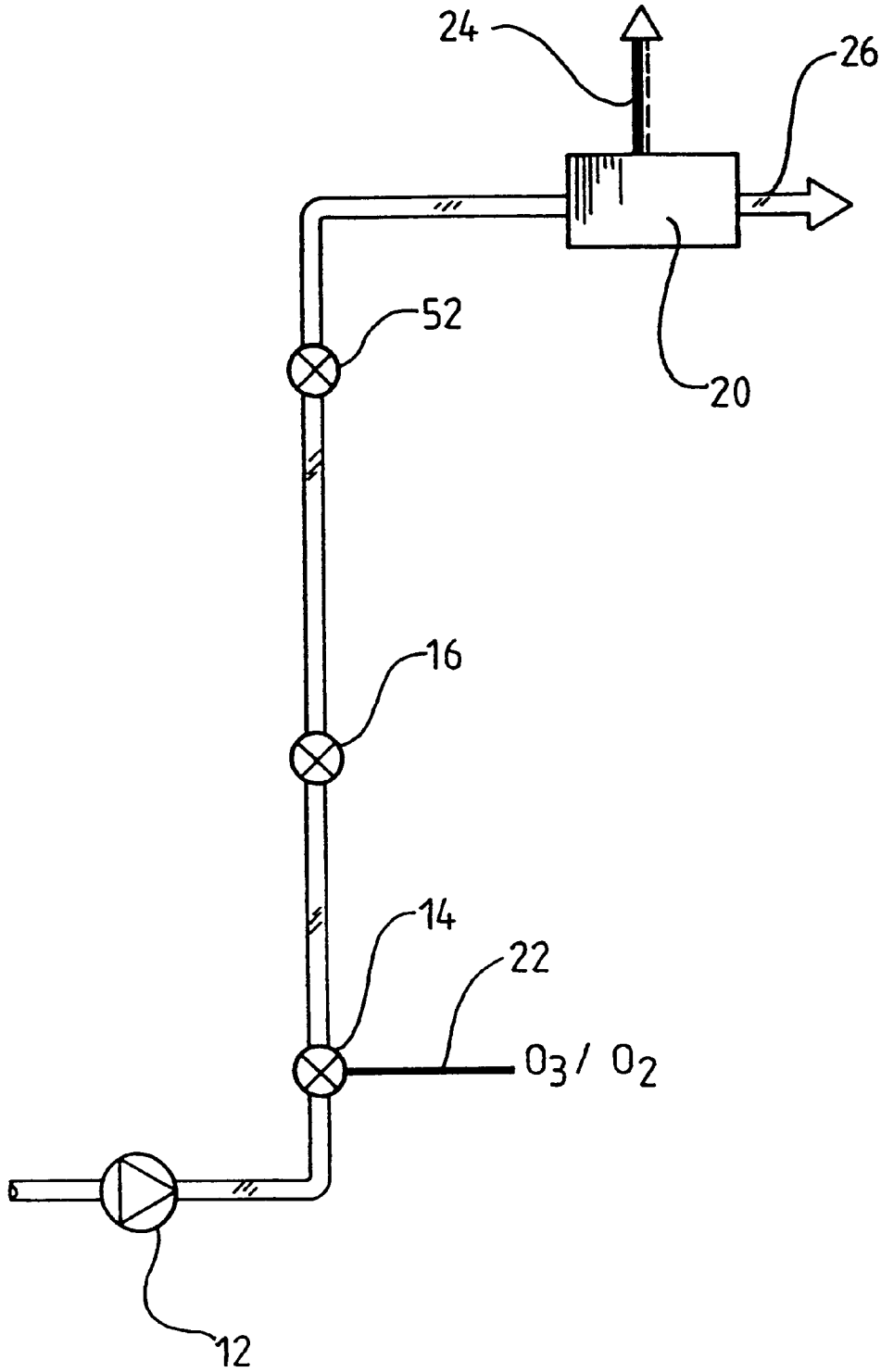
FIG. 4 illustrates a fourth preferred embodiment of the apparatus according to the invention.

In FIG. 4 there is shown a further embodiment of the arrangement of FIG. 2 where the reaction vessel has been replaced with somewhat longer, extended pipelines between the mixers 14, 16 and 52 and especially between the last mixer 52 and the gas separator 20. Also the diameter of the pipelines between the mixers 14, 16, 52 and between the mixer and the gas separator 20 may be somewhat larger than normally. In spite of the fact that three mixers are shown in this embodiment it is possible to apply the idea of replacing the reaction vessel with a mere pipeline in case where there are only two mixers or even more than three mixers.

Figure 5:
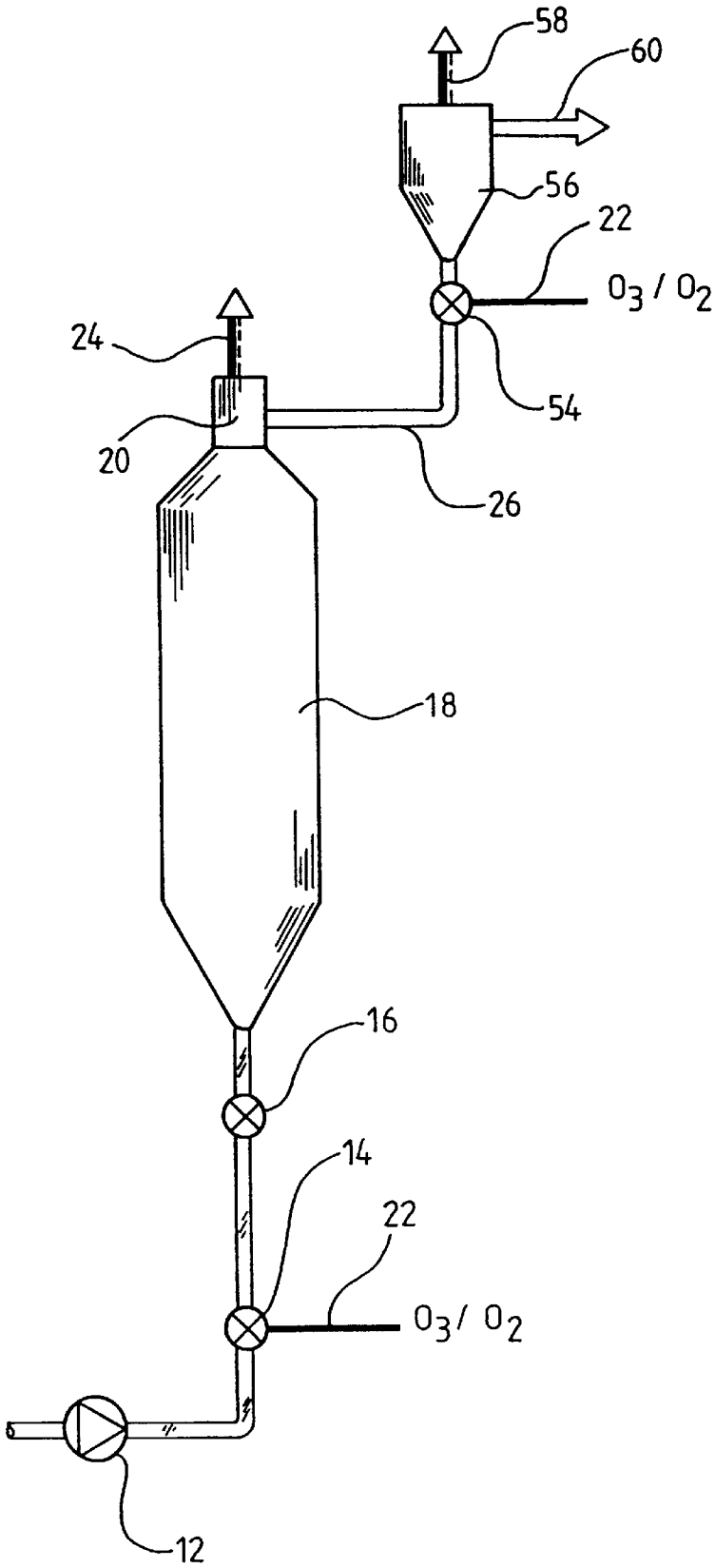
FIG. 5 illustrates a fifth preferred embodiment of the apparatus according to the invention.

In FIG. 5 there is shown a further embodiment of the invention where the arrangement is basically the same as shown in FIG. 1 with the exception that after the pulp has been discharged from the reaction vessel 18 and the gas separator 20 it is once more subjected to an ozone bleaching stage by means of mixing the mixture of ozone and carrier gas into the pulp in a fluidizing mixer 54 whereafter the pulp is introduced into a gas separator 56 which may be one of those cited already earlier or also a centrifugal separator like for instance a hydrocyclone from where the gas is discharged via duct 58 and the degassed bleached pulp via conduit 60.

As can be concluded from the above a method and apparatus have been developed, which are better than prior art bleaching methods, for use in ozone bleaching or any other bleaching requiring large volumes of gas. Thus, even though ozone bleaching, only, and even that particularly as taking place with a mixture of ozone and oxygen, has been described in the embodiments above it is evident that the ozone can be supplied with any suitable carrier gas and that the apparatus is applicable to the mixing of any bleaching chemical but it is particularly suitable for mixing bleaching chemicals in the form of large gas volumes. Further, it is clear that even though many patented apparatus alternatives have been referred to above also other fluidizing mixers and gas separators can be used.

I claim:

1. A method of ozone bleaching cellulose pulp having a consistency of 5–25% using first and second fluidizing mixers, comprising the steps of sequentially:

(a) in the first fluidizing mixer at a pressure of 6–15 bar mixing cellulose pulp having a consistency of 5–25% with a mixture of ozone gas in carrier gas in an amount of 2–5 cubic meters per air dried ton of the cellulose pulp to form a fluidized mixture of pulp, ozone and carrier gas so that some ozone reacts with pulp to effect bleaching but non-reacted ozone remains;

(b) transferring the mixture of pulp, non-reacted ozone, and carrier gas from the first fluidizing mixer directly to the second fluidizing mixer;

(c) in the second fluidizing mixer, without introducing any additional ozone therein, refluidizing the mixture of pulp, non-reacted ozone, and carrier gas from the first fluidizing mixer, the ozone further reacting with the pulp to effect bleaching, but some residual ozone and carrier gas remaining mixed with the pulp, and discharging the mixture of residual ozone, carrier gas, and pulp from the second fluidizing mixer;

(d) maintaining the residual ozone in contact with the pulp for a time sufficient for further reaction of ozone with the pulp to effect bleaching to take place; and (e) separating carrier gas and unreacted ozone from the pulp.

2. A method as recited in claim 1 utilizing a third fluidizing mixer, and comprising the further steps, between steps (c) and (d), of: (f) transferring the mixture of pulp, non-reacted ozone, and carrier gas from the second fluidizing mixer directly to the third fluidizing mixer; and (g) in the third fluidizing mixer, without introducing any additional ozone therein, refluidizing the mixture of pulp, non-reacted ozone, and carrier gas from the second fluidizing mixer, the ozone further reacting with the pulp to effect bleaching, but some residual ozone and carrier gas remaining mixed with the pulp, and discharging the mixture of residual ozone, carrier gas, and pulp from the third fluidizing mixer.

3. A method as recited in claim 1 wherein step (b) is practiced utilizing a pipeline connecting the first and second fluidizing mixers.

4. A method as recited in claim 2 wherein step (f) is practiced utilizing a pipeline connecting the second and third fluidizing mixers.

5. A method as recited in claim 2 wherein step (d) is practiced by introducing the mixture into a reaction vessel and maintaining the pulp in the reaction vessel to allow further reaction of residual ozone with the pulp to effect bleaching.

6. A method as recited in claim 5 wherein the mixture includes gas bubbles; and wherein step (d) is further practiced by tumbling the mixture of pulp, residual ozone, and carrier gas in the reaction vessel so that gas bubbles in the mixture break or separate from the mixture so that the ozone is better able to react with the pulp.

7. A method as recited in claim 5 wherein step (d) is further practiced by, maintaining the pulp in the reaction vessel at a pressure of 6–15 bar.

8. A method as recited in claim 7 wherein step (d) is further practiced by providing a temperature of about 50–90° C. in the reaction vessel, and wherein the mixture has a pH of 3–5 in the reaction vessel.

9. A method as recited in claim 8 wherein step (d) is practiced for 30–150 seconds.

10. A method as recited in claim 1 wherein step (d) is practiced for 30–150 seconds.

11. A method as recited in claim 1 wherein the pulp during the practice of steps (a)–(e), has a consistency of 10–15%.

12. Apparatus for bleaching cellulose pulp having a consistency of 5–25%, comprising:

a fluidizing pump having an inlet for cellulose pulp at a consistency of 5–25%, and an outlet;

a first fluidizing mixer having an inlet connected to said fluidizing pump outlet, an outlet, and a conduit for introducing a mixture of ozone and carrier gas;

a second fluidizing mixer having an inlet directly connected to said first fluidizing mixer outlet, and an outlet, said second fluidizing mixer devoid of any mechanism for introducing ozone and carrier gas thereinto;

a gas separator for separating gas from pulp; and a superatmospheric pressure flow channel connected between said second fluidizing mixer outlet and said gas separator.

13. Apparatus as recited in claim 12 wherein said flow channel comprises a superatmospheric pressure reaction vessel.

14. Apparatus as recited in claim 13 wherein the pulp has gas bubbles; and wherein said reaction vessel includes means for tumbling pulp therein so that gas bubbles in the pulp break or separate from the pulp so that the ozone mixed with the pulp is better able to react with the pulp.

15. Apparatus as recited in claim 13 wherein the reaction vessel is at a pressure of 6–15 bar.

16. Apparatus as recited in claim 13 wherein the reaction vessel is a vertical reaction vessel with an inlet at the bottom and an outlet at the top; and wherein said gas separator is at the top of said reaction vessel.

17. Apparatus as recited in claim 12 further comprising a third fluidizing mixer having an inlet directly connected to said second fluidizing mixer outlet, and an outlet directly connected to said flow channel, said third fluidizing mixer devoid of any mechanism for introducing ozone and carrier gas thereinto.

18. Apparatus as recited in claim 14 wherein said reaction vessel is horizontally elongated.

19. Apparatus as recited in claim 18 wherein said tumbling means comprises a paddle mixer in said horizontally elongated reaction vessel.

20. Apparatus as recited in claim 13 further comprising a third fluidizing mixer connected to said gas separator and a conduit for introducing ozone and carrier gas into said third fluidizing mixer, and a second gas separator connected to said third fluidizing mixer.

* * * * *

UNITED STATES PATENT AND TRADEMARK OFFICE

CERTIFICATE OF CORRECTION

PATENT NO. : 6,358,363 B1
DATED : March 19, 2002
INVENTOR(S) : Henricson

It is certified that error appears in the above-identified patent and that said Letters Patent is hereby corrected as shown below:

Title page,
Item [*] Notice, delete "713" and insert -- 0 --.

Signed and Sealed this

First Day of July, 2003

JAMES E. ROGAN
*Director of the United States Patent and Trademark Office*